US005269623A

United States Patent [19]

Hanson

[11] Patent Number: 5,269,623

[45] Date of Patent: Dec. 14, 1993

[54] RAPIDLY DEPLOYABLE TRAFFIC SCREEN

[76] Inventor: James L. Hanson, 4451 W. 167th St., Lawndale, Calif. 90260

[21] Appl. No.: 855,874

[22] Filed: Mar. 23, 1992

[51] Int. Cl.[5] ..... G09F 15/00

[52] U.S. Cl. ..... 404/6; 52/2.18; 40/612; 256/13.1

[58] Field of Search ..... 404/6, 9; 256/1, 13.1, 256/DIG. 2, 45; 40/610, 612; 52/2.18, 2.19, 2.24, 2.25, 2.26

[56] References Cited

U.S. PATENT DOCUMENTS

| | | | |
|---|---|---|---|
| 3,332,176 | 7/1967 | Knetzer | 52/2.19 |
| 3,877,681 | 4/1975 | Humphrey | 256/1 X |
| 4,465,262 | 8/1984 | Itri et al. | 256/24 |
| 4,776,121 | 10/1988 | Vicino | 40/610 |
| 4,918,877 | 4/1990 | Dutka | 52/2.19 |
| 5,125,177 | 6/1992 | Colting | 40/610 |
| 5,152,092 | 10/1992 | O'Brien | 40/612 X |

*Primary Examiner*—William P. Neuder
*Attorney, Agent, or Firm*—Roger A. Marrs

[57] ABSTRACT

A sight barrier or screen is disclosed herein for temporarily obstructing oncoming motorists' view from accident scenes which includes an elongated screen or shield having a stowed position deployable into an operative position by inflation of tubular or conduit members. A main or base conduit is included having outwardly projected leg members for supporting the screen or shield in the operative position and further having upwardly projecting stanchions in spaced-apart relationship supporting a plurality of sight barriers therebetween. A source of pressurized gas is operably connected to the main base conduit for rapid deployment of the shield into its operative position and ground engaging or retention devices are included for holding the shield in place at the accident site.

12 Claims, 1 Drawing Sheet

RAPIDLY DEPLOYABLE TRAFFIC SCREEN

BACKGROUND OF THE INVENTION

1. Field of the Invention

The present invention relates to the field of sight barriers, and more particularly to a novel temporary sight shield that may be readily deployed from a stowed position into an operative position at the scene of a traffic accident in order to provide a temporary shield separating oncoming traffic from the accident scene so as to obscure or block the vision of the oncoming traffic from the traffic accident.

2. Brief Description of the Prior Art

In the past, freeway accidents in densely populated areas oftentimes caused traffic jams, partly as a result of curious drivers slowing down to see what event has caused the accident. Problems and difficulties have been encountered due to the slowdown of traffic which further induces traffic delays that greatly restrict current freeway systems' ability to handle higher traffic volume. From an environmental perspective, such slowdown of traffic may induce millions of tons of pollutants into the atmosphere by nonproductive idling vehicles encountering the traffic jams. Further, lost man hours on the road are nonproductive as well.

Additional problems encountered with traffic jams and slowdowns reside in causing secondary accidents which may occur as the result of distracted drivers and emergency personnel at the scene are sometimes injured due to such distraction.

Therefore, a long-standing need has existed to provide a sight shield or screen which will separate oncoming motorists' vision from a recently occurring accident so that the motorist will be motivated to maintain speed and to leave the accident site as rapidly as possible. Such a screen or shield is of a temporary nature and must be readily available for deployment at the accident site for temporarily obscuring oncoming motorists' view. When the accident drama is over, the shield must be returned to condition for repeated use at other locations and times.

SUMMARY OF THE INVENTION

Accordingly, the above problems and difficulties are obviated by the present invention which provides a novel visual screen or shield adapted to be deployed from a stowed position into an operative position by selectively releasing a pressurized gas into a main conduit so that the screen is fully deployed. The main conduit includes outwardly projecting leg members which include antifriction means for ground retention to support the screen and further includes inflatable upright stanchions arranged in fixed spaced-apart relationship along the length of the conduit. A sightbarrier such as close mesh netting or criss-cross bracing is provided between adjacent ones of the stanchions to reinforce the net but to permit the passage of wind therethrough. Inflatable means are incorporated into the barrier for automatic release of the gas for rapid deployment and means are provided for retaining the screen in the ground contact. Such latter means may include antifriction means carried on the screen or shield supporting legs as well as weighted means such as sandbags or the like. Also, an extension support of a rigid nature may support the ends of the barrier to fixed structure, such as an emergency vehicle, posts or the like.

Therefore, it is among the primary objects of the present invention to provide a novel sight barrier for temporary deployment at the scene of an accident so that the view of oncoming motorists is obstructed.

Another object of the present invention is to provide a novel inflatable sight shield that may be automatically inflated at the scene of an accident and which may be kept in ground support retention so that the sight barrier will remain in position during the emergency.

Yet another object of the present invention is to provide an inflatable barrier means that may be deployed from a stowed position into an operative position at the scene of an accident and which will serve to visually obstruct the view of oncoming motorists.

Still a further object resides in the employment of bands for holding added weight to the support base of a visual shield in order to hold or retain the shield in sites for an extended period of time such a road maintenance situations.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
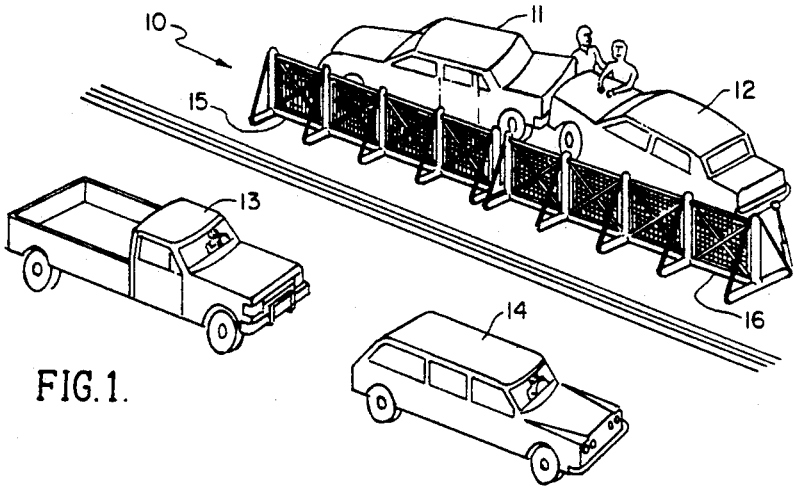
FIG. 1 is a diagrammatic view illustrating the novel deployable traffic screen or shield incorporating the present invention.

Referring to FIG. 1, the barrier or shield of the present invention is indicated in the general direction of arrow 10 and the shield is illustrated in connection with obscuring an automobile accident involving automobiles 11 and 12 from the view of oncoming motorists in vehicles 13 and 14. In a typical situation, the pair of barriers is illustrated, such as identified by numerals 15 and 16 respectively, which are placed in an end-to-end relationship. A retaining means is indicated by numeral 17 which is operable for holding the barriers in position so that they will not be dislodged by wind or other forces which may tend to move the barriers from their intended site. The retention means 17 includes a telescoping rigid rod which is pivotally carried on one end to the barrier and includes an attachment means for releasably connecting with a vehicle, such as vehicle 12. In some instances, emergency vehicles at the site may be used for the holding or retaining function.

Figure 2:
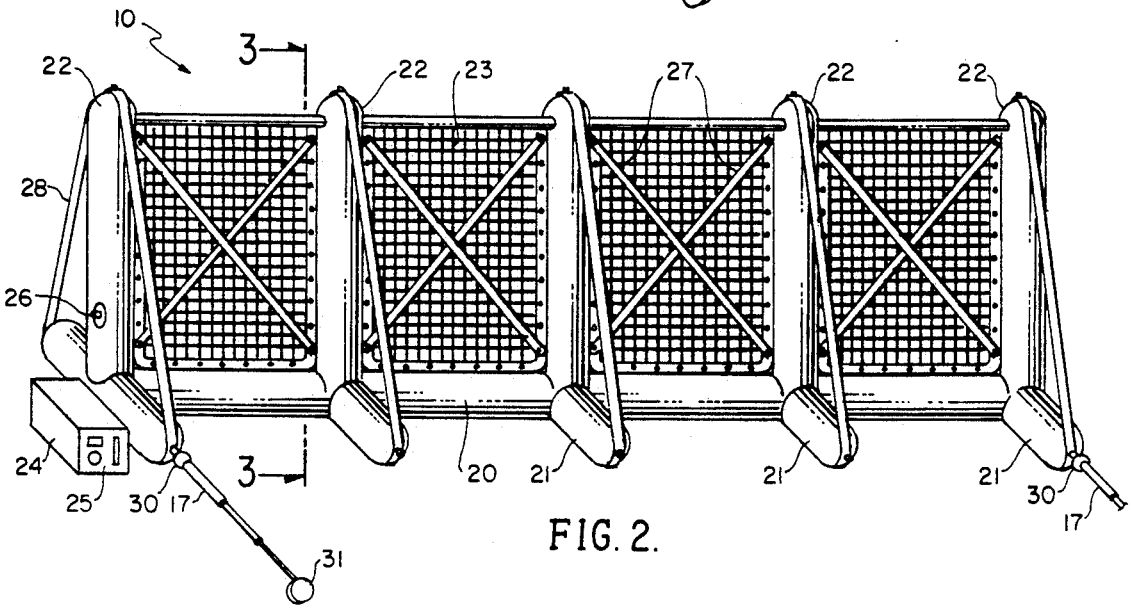
FIG. 2 is a front perspective view of the deployable traffic screen or shield shown in FIG. 1.

Referring to FIG. 2, the novel barrier of the invention is illustrated in its deployed or operative position. The shield includes an elongated main or base conduit 20 from which a plurality of leg members, such as member 21, outwardly extend to form a support for the barrier. A plurality of upright stanchions, such as illustrated by numeral 22, is provided on the main or base conduit 20 so that a sight barrier, as indicated by numeral 23, can be mounted between adjacent ones of the respective stanchions. It is to be understood that the upright stanchions,leg members and main conduit are in fluid communication with each other and that these members are composed of a tough pliable or flexible material so that upon the introduction of a pressurized gas into the interior thereof, expansion of the shield will take place from a stowed position to the operative position as illustrated. Preferably, a $CO_2$ cartridge is indicated by numeral 24 and is contained within a housing 25. The housing includes a lid so that the $CO_2$ can be withdrawn for service and maintenance purposes or for purposes of replacement. Numeral 26 relates to a pressure relief valve so that should the pressure within the conduits, leg members or stanchions become substantial, the valve will open to relieve pressure.

It is to be noted that the sight barrier 23 is a close mesh net or it may include a plurality of braces 27 which not only support the net but are employed for obscuring the view through the barrier. The netting and braces may be readily attached by any suitable means such as stringing, snaps, grommets or the like. The pressure relief valve 26 may also be used for deflating the device when it is desired to place the barrier in storage. A simple pressing of the valve will cause the pressurized gas to escape and reduce the shield from its operative position to a position where it can be folded and placed into a bag for storage.

Figure 3:
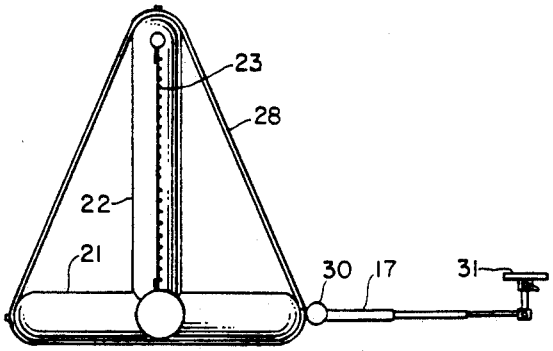
FIG. 3 is a transverse cross-sectional view of the deployed traffic screen taken in the direction of arrows 3—3 of FIG. 2.

In order to maintain the shield on the ground, it can be seen in FIGS. 2 and 3 that friction means, such as bands which are held in tension, can be placed about the upright stanchions and the leg members and such a tension band is illustrated by numeral 28. It can be seen that the band extends over the top of each stanchion and around the cantilevered end of each of the respective leg members and passes beneath each of the leg members so as to come in frictional contact with the ground on which the shield is supported. Also, it can be seen in FIGS. 2 and 3 that an extension arm 17 is employed having a pivoted end 30 connected to one end of the shield and a magnetic plate 31 carried on the other end of the extension arm. The magnetic plate may be placed into contact with a metal portion of an emergency vehicle and one of the autos involved in the crash. Such connection will rigidly hold the screens in their deployed and operable position. The extension arm 17 is of a telescoping construction so that its length can be readily adjusted to suit the situation. Added weights may be held in place by the band 28.

Figure 4:
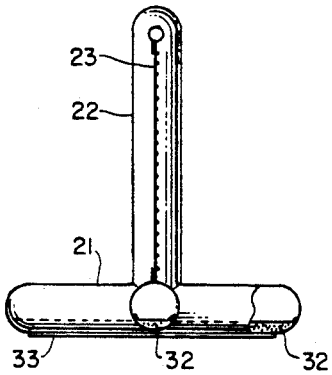
FIG. 4 is an end elevational view of another embodiment of the present invention having improved retention means for holding the screen in its operative position.

With respect to FIG. 4, an alternate means is illustrated to retain the barrier or shield in position which constitutes an internal carrying of sand, beans or other weighted material, as indicated by numeral 32. Such weighted material is carried on the bottom of each leg member and if further friction is needed, a rubberized or frictional substance may be placed or coated on the exterior surface of the underside of the leg member and such material is indicated by numeral 33. Therefore, in view of the foregoing, it can be seen that the novel shield or screen of the present invention provides a unique means for shielding an auto accident from oncoming motorists. The technology employed in the shield is similar to an emergency liferaft inasmuch as inflation and deflation are concerned. The shield is a pneumatic device deflated by a quick release of gas from a liquid $CO_2$ tank. The device is generally packed in a Velcro outer cover which will give way as the shield inflates.

The shield in the stowed state prior to deployment, will have a carrying handle and a quick release device, $CO_2$ tank and emergency flashing battery adjacent to the handle. The protective cover for the quick release may be readily opened and the deployment line tugged to begin inflation. If desired, a pushbutton system can be employed. The shield unrolls as it inflates from one end towards the other end and in a matter of seconds is fully deployed. The fabric is stretched across the pneumatic support members and is of a highly reflective, lightweight Mylar-like material. The fabric can be slotted or screen-like to allow the wind to pass through. High frequency, highly visible emergency flashing lights can be attached to both sides of the barrier.

While particular embodiments of the present invention have been shown and described, it will be obvious to those skilled in the art that changes and modifications may be made without departing from this invention in its broader aspects and, therefore, the aim in the appended claims is to cover all such changes and modifications as fall with in the true spirit and scope of this invention.

What is claimed is:

1. A deployable traffic screen comprising:

an elongated base;

a plurality of leg members outwardly projecting from opposite sides of said base normal to a longitudinal axis of said base;

a multiplicity of upright stanchions carried on the top of said base in spaced-apart relationship normal to said base longitudinal axis and to said leg members;

said base, said stanchions and said leg members composed of a flexible, foldable air-tight material and in enclosed internal fluid communication with each other;

a netting carried between adjacent ones of said upright stanchions obstructing visual observation therethrough; and means carried on said base for selectively inflating said base, said stanchions and said leg members into an elongated shield with said leg members constituting a ground support and said upright stanchions constituting a visual screen.

2. The invention as defined in claim 1 including:

means carried on said leg members for retaining said base and said leg members in engagement with ground supporting surface.

3. The invention as defined in claim 2 wherein:

said retaining means includes a weighted mass carried on each of said leg members.

4. The invention as defined in claim 2 wherein:

said retaining means includes an extendable arm carried on each end of said base;

attachment means mounted on said arm adapted for releasable engagement with a support means.

5. The invention as defined in claim 4 wherein:

said attachment means is a magnetic element.

6. The invention as defined in claim 5 including:

antifriction means carried about said leg members and said upright stanchions having frictional characteristics for supporting said leg members in sites.

7. A temporary traffic screen comprising:

an elongated inflatable shield having a support base with upright stanchions normal to the longitudinal axis of said support base and said stanchions arranged in spaced-apart relationship;

restrictive sight means carried between adjacent ones of said upright stanchions;

said shield having a stowed position in which said shield is foldable over upon itself and an unfolded deployed position in which said shield is elongated and rigid so as to tension said restrictive sight means; and inflation means operably carried on said shield support base for supplying a pressurized gas to said inflatable shield to deploy said shield from its stowed position to its operative position.

8. The invention as defined in claim 7 wherein:

means operatively carried on said shield for supporting said shield in situ in its inflated operable position.

9. The invention as defined in claim 8 wherein:

said support means includes an extendable arm carried on opposite ends of said support base adapted to detachably engage with adjacent support structure.

10. The invention as defined in claim 9 wherein:

a weighted mass;

said support means further includes bands extending about said support base and said upright stanchions for holding said weighted mass.

11. The invention as defined in claim 10 including:

pressure relief means mounted on said shield operable to selectively release pressurized gas from said shield when in its deployed operable position.

12. The invention as defined in claim 11 wherein:

said restrictive sight means comprises a netting carried between adjacent ones of said stanchions placed in tension when said shield is in said inflated deployed position.

* * * * *